United States Patent [19]

Flechner

[11] 4,429,871

[45] Feb. 7, 1984

[54] HYDRAULIC EXERCISER

[75] Inventor: Paul F. Flechner, Costa Mesa, Calif.

[73] Assignee: AMF Incorporated, White Plains, N.Y.

[21] Appl. No.: 320,365

[22] Filed: Nov. 12, 1981

[51] Int. Cl.[3] ..... A63B 21/10

[52] U.S. Cl. ..... 272/130; 272/134; 272/144

[58] Field of Search ..... 272/130, 134, 144, 145, 272/146

[56] References Cited

U.S. PATENT DOCUMENTS

| | | | |
|---|---|---|---|
| 3,342,485 | 9/1967 | Gaul | 272/145 |
| 3,756,595 | 9/1973 | Hague | 272/130 X |
| 4,226,415 | 10/1980 | Wright | 272/130 |
| 4,240,627 | 12/1980 | Brentham | 272/130 |
| 4,241,913 | 12/1980 | Zwayer et al. | 272/130 |
| 4,254,949 | 3/1981 | Brentham | 272/130 |

*Primary Examiner*—William H. Grieb

*Attorney, Agent, or Firm*—David E. Dougherty; Walter R. Pfluger

[57] ABSTRACT

An adjustable hydraulic exerciser having multiple stations with each station being adapted for multiple exercises.

25 Claims, 6 Drawing Figures

HYDRAULIC EXERCISER

This invention relates to a hydraulic exerciser, and more particularly, to an improved adjustable hydraulic exerciser having multiple stations for performing multiple exercises at each station.

Multiple station exercisers employing weights and/or springs as the resistance force are known. So also are hydraulic resistance exercisers, U.S. Pat. Nos. 4,185,818 and 4,240,627 being recent examples thereof. All these devices have any one or more of the following disadvantages. Some units are limited in that the person using the machine can assume only one body position. Others, although they may have multiple stations, are limited in the kind of exercise which can be performed at each station. Some units may not be balanced when each of a pair of arm or leg limbs are being simultaneously exercised. Still other units may not be adjustable, or sufficiently so, in terms of load, starting point, distance or sweep, and direction. The above disadvantages mean that prior art units are not adapted to nor versatile enough to have a large multiplicity of meaningful exercises with a single unit.

It is an object of this invention to provide a simple, yet low cost, exerciser which can be used to perform a multiplicity of exercises therewith.

It is a further object of this invention to provide a simple, yet low cost exerciser which has multiple stations with multiple exercises being performed at each station.

It is a further object of the invention to provide a hydraulic exerciser which is balanced in terms of load and distance, when a pair of limbs are being simultaneously exercised, which move in opposite directions.

It is a further object of this invention to provide a simple low cost hydraulic exerciser which is adjustable in terms of load, starting point, distance or sweep, and direction.

Briefly, in the invention the exerciser is reduced to a small number of essential parts to reduce its complexity and costs, and these parts are interrelated in such a way that multiple stations are provided with multiple body positions and exercises being possible at each station. As a further feature thereof, the exerciser is balanced in terms of load and displacement, and its versatility is further increased by making it fully adjustable in terms of load, starting point, displacement or sweep, direction, velocity, and change of rate of velocity.

The invention will be best understood by considering the following detailed description of one embodiment thereof taken in connection with the accompanying five sheets of patent drawings in which.

and

Figure 1:
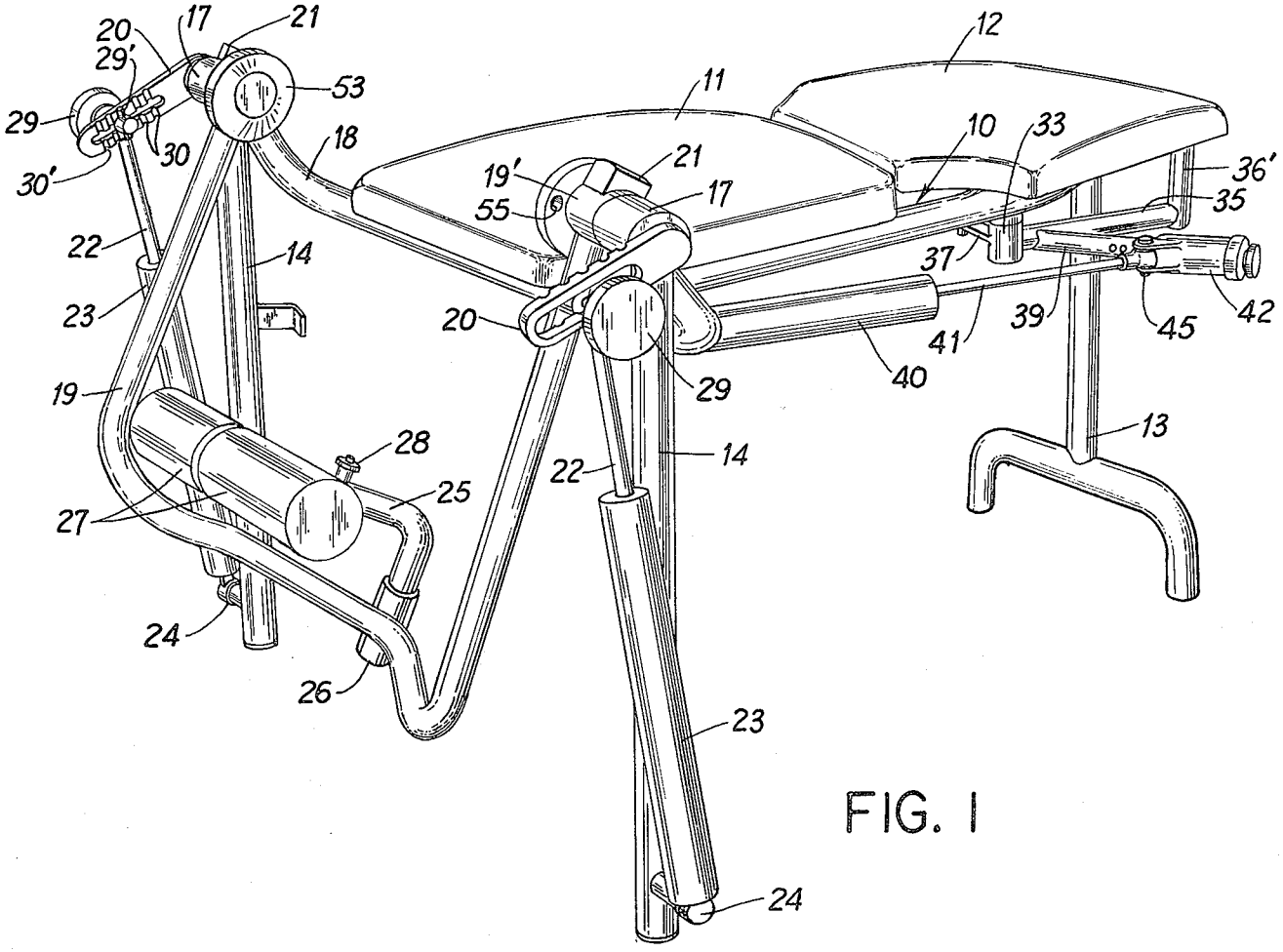
FIG. 1 is a perspective view of one embodiment of the invention.
Figure 2:
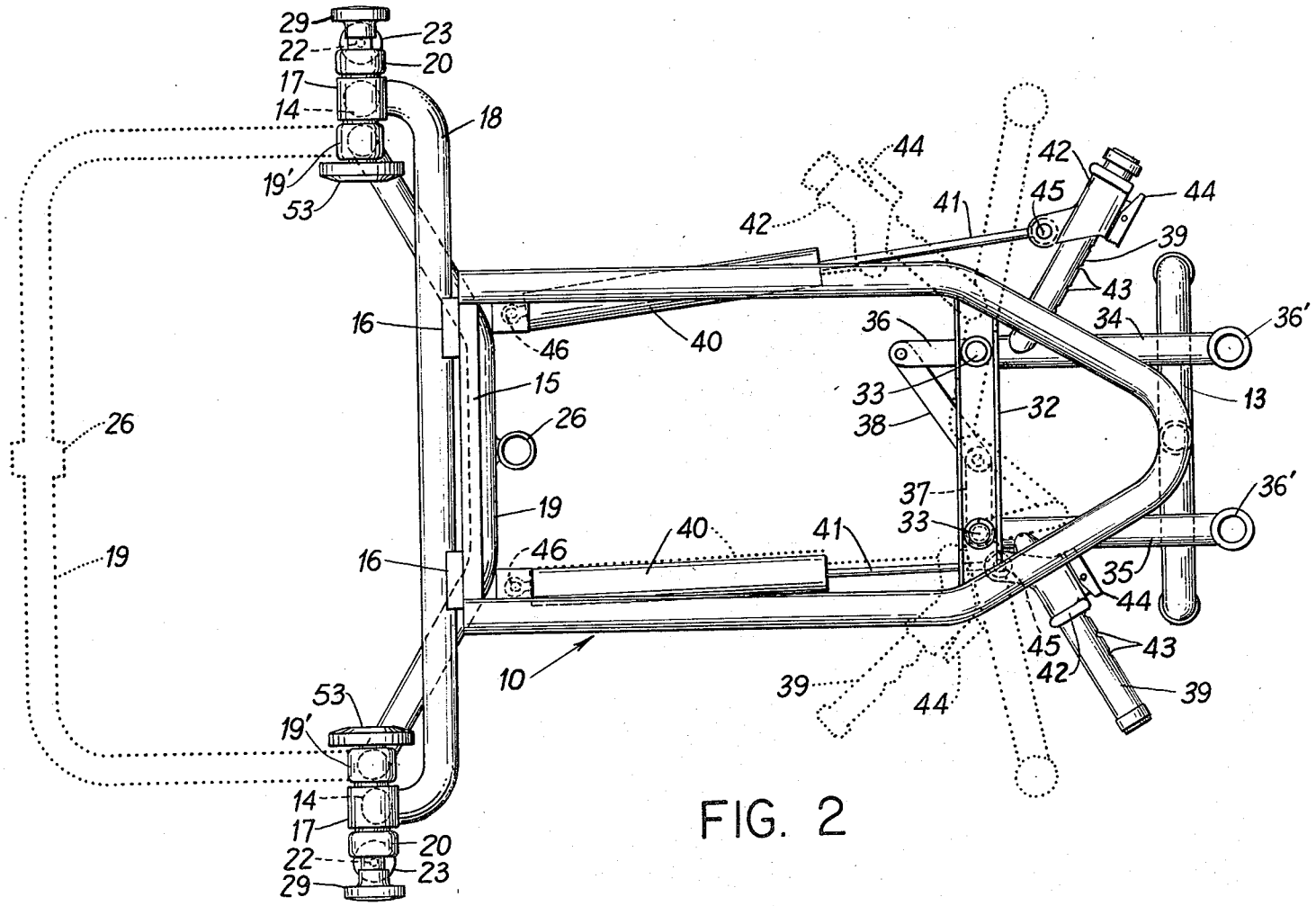
FIG. 2 is a top plan view.
Figure 3:
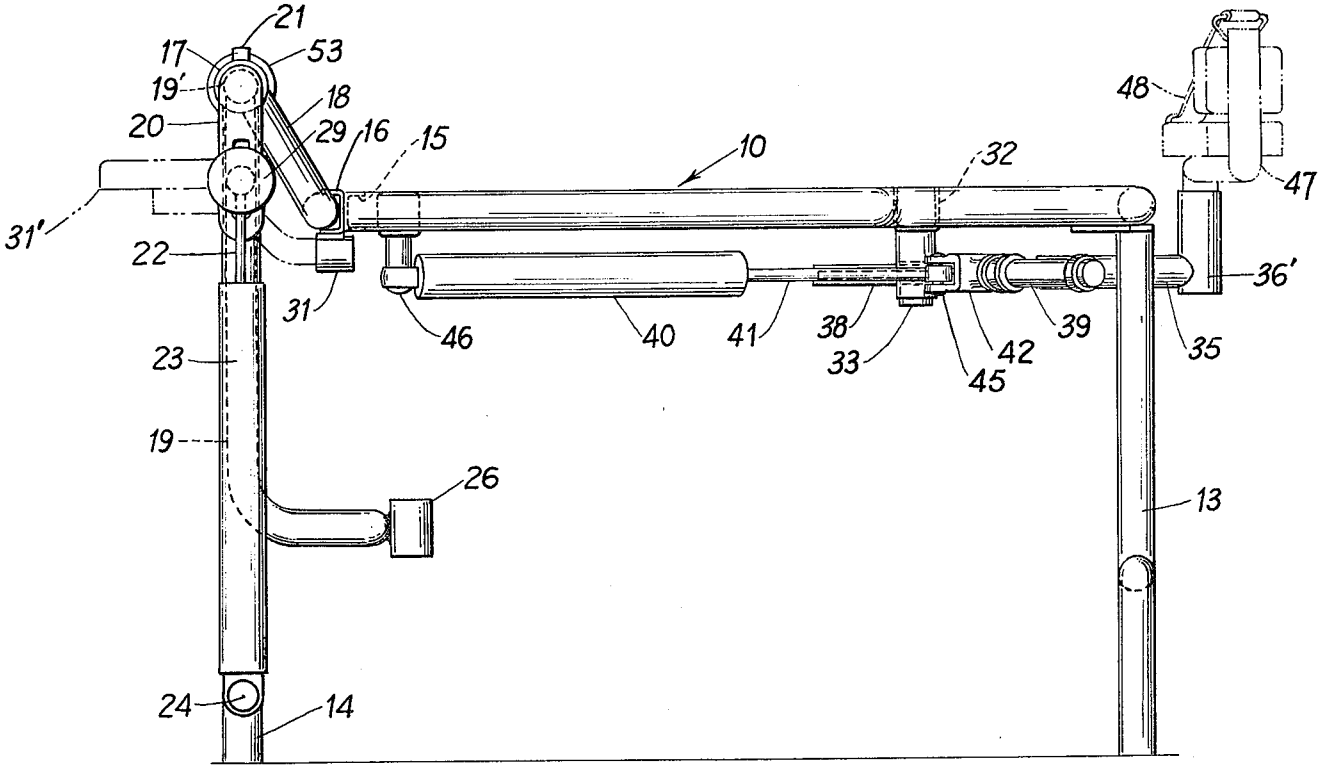
FIG. 3 is a side elevation view.
Figure 6:
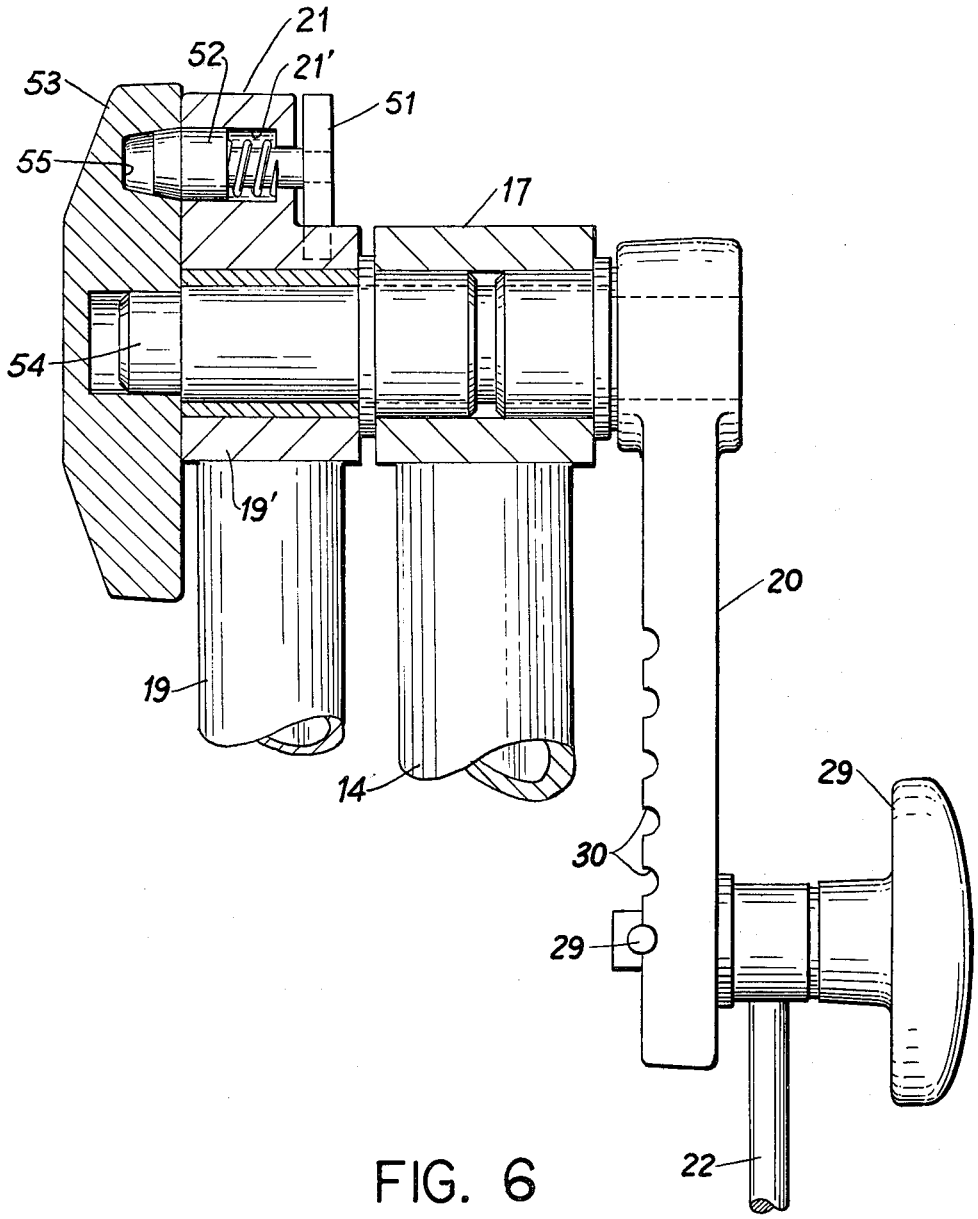

FIG. 6 is an enlarged sectional view of the adjusting means on the near side at the left hand end of FIGS. 1–3, the adjusting means at both sides being the same.

Figure 4:
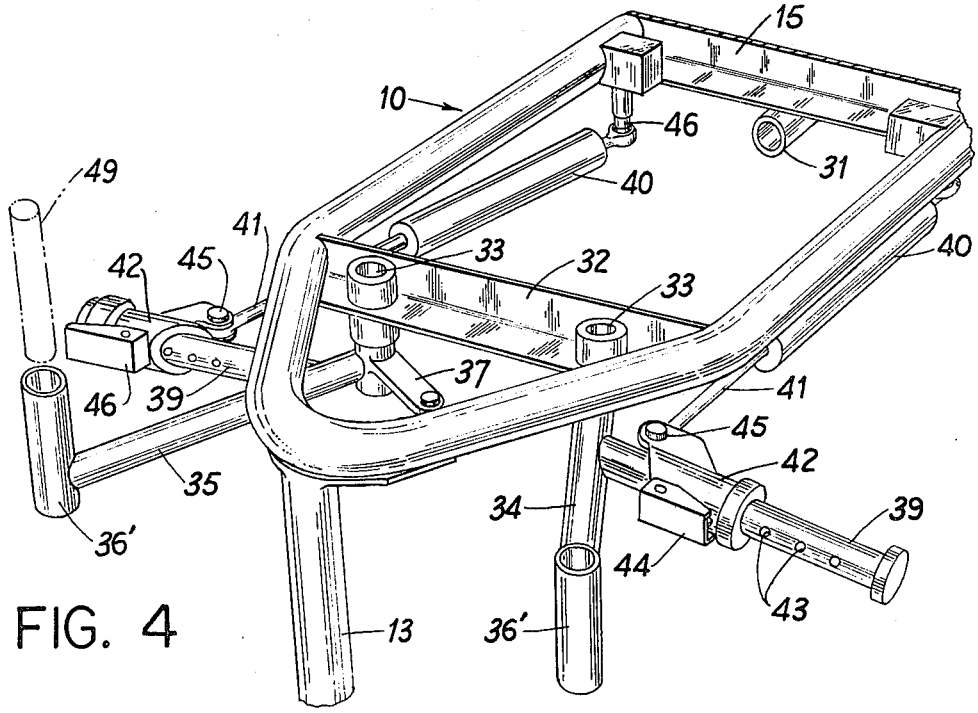
FIG. 4 is a perspective view from the right hand end of FIGS. 1–3.

In FIGS. 2–4 some of the parts shown in FIG. 1, such as the table cushions 11,12 have been omitted for purposes of better showing the underlying frame 10 and operative parts.

Turning now to the patent drawings, shown therein is an exerciser having a table or bench comprising a generally U-shaped frame 10 having a pair of cushions 11 and 12 thereon. Cushioned frame 10 is supported in elevated position by a T-shaped leg 13 at one end thereof and a pair of legs 14 at the other end thereof. The T-shaped leg 13 is at the end of the frame 10 corresponding to cushion 12, and the pair of legs 14 at the end of frame 10 corresponding to cushion 11.

The two cushions 11 and 12 correspond to two different exercise stations at opposite ends of the exercise table. At the cushion 11 end of the table a user can be seated on the cushion 11 and perform knee extension exercises. Also, by lying on the table face down with the legs extending out over the cushion 11 knee flexion (i.e., leg curl) exercises can be performed. Additionally by lying on the table face up and with the shoulders on the cushion 11 shoulder extension (pull over) and shoulder flexion (chest press) exercise patterns can be performed.

Multiple exercises can also be performed at the other end of the exerciser unit corresponding to the cushion 12 end or station. By being seated on the cushion 12 a user can perform hip adduction (leg scissor) and hip abduction (hip extension) exercises, and by lying on the table face up with the shoulders on the cushion 12 a user can perform shoulder abduction (shoulder raise) and shoulder adduction (back pull-down) exercises.

The ability to perform multiple exercises at multiple stations or ends of the unit will be further described and become more clear after a detailed description of the structure and of the function is presented.

As shown in FIGS. 2 and 3, a channel shaped bar 15 spans the free ends of the U-shaped table frame member 10. A pair of short channel shaped members 16 are connected to the back of member 15 at its opposite ends. The pair of legs 14 have collars 17 at the upper end thereof. The table 10–12 is connected to the legs 14 by a fixed U-shaped member 18. Member 18 is affixed at its back portion to members 16 which in turn are affixed to the bar 15 which is affixed to the frame member 10. At its free ends the member 18 is affixed to the collars 17 at the upper end of legs 14.

An exercise input or resistance arm 19, which is U-shaped, is rotatably mounted at its free ends at the collars 19 adjacent to collars 17 to pivot about the axes thereof. Also pivotal at the collars 17 about the axes thereof is a pair of crank arms 20. Locking means 21 is provided at the opposite sides of the unit to lock the input arm 19 and cranks 20 together to move in unison, or to unlock them with respect to each other so that their start positions as well as their positions relative to each other can be adjusted. The outer ends of the crank arms 20 have piston rods 22 adjustably connected thereto. The other ends of the rods 22 have not shown valved pistons which work in hydraulic cylinders 23, the lower ends of the cylinders being pivoted to the pair of legs 14 adjacent the lower ends thereof at pivot points 24.

The details of the locking means 21 for engaging and disengaging the cranks 20 with the exercise resistance arm 19 will be described in detail hereinafter in connection with FIGS. 5 and 6. Suffice to say that with parts 19,20 being locked together to move in unison, when the arm 19 is raised (see FIG. 1) it pulls up on the crank arms 20 from their always starting position of about 45° with respect to the horizontal, which movement is resisted by the valve pistons connected to the rods 22 working against the fluid in the hydraulic cylinders 23. The parts 22,23 are one-way acting hydraulic shock absorbers and offer no resistance to return movement to their unextended position.

A fitting is provided on the exercise resistance arm 19 to facilitate doing knee extension exercises. The fitting comprises an L-shaped member 25 which enters a collar 26 at the center of the arm 19. The other end of L-shaped member 25 receives a T-shaped member having a pair of roller cushions 27 thereon. The position of members 25 and 27 with respect to each other can be adjusted at adjusting means 28, and similarly at the parts 25,26 with respect to each other.

To do knee extension exercises the user of the unit is seated on the cushion 11 with the legs bent at the knees so that they are positioned between the roller cushions 27 and the arm 19 at the ankles. When the user extends the legs to straighten them at the knees this is resisted by the hydraulic shocks connected to the exercise arm 19. After raising the arm 19 it is lowered to the down position by pushing against the arm 19 with the back of the legs at the ankles.

To do leg curl exercises the user of the unit unlocks the arm 19 at both locking means 21 so that the start position of the arm 19 can be rotated from the down position to the horizontal position and the locking means are resecured. If the user now lies face down on the cushions 11,12 with the user's legs straight and between the cushion rollers 27 and arm 19 at the ankles the machine and user are now set up to do leg curl exercises. As the user's legs are flexed at the knees this movement is resisted by the arm 19 and the shocks 22,23 connected thereto. The arm 19 is returned to the start position by pushing down on it with the legs from the raised to the extended position.

In both of these just described knee extension and knee flexion exercises the input arm 19 is moved about 90 degrees, in the first starting from a down position, and in the second starting from the horizontal position for the arm 19. This is what was meant heretofore in stating that the start position of the resistance arm can be adjusted in the invention to alter the start position thereof to facilitate doing different exercises at each station of the unit, in this instance at the cushion 11 end of the device. Of course, it is also possible to do different exercises because the machine makes it possible for the user to change his body position with respect to the machine, depending upon which exercise the user wants to do.

Besides making it possible to adjust the position of the user's body and the start position of the resistance arm 19, in the invention it is also possible to adjust the amount of resistance force imposed on the arm 19. This is accomplished in a simple and straightforward manner, that is to say, without the need for any sophisticated adjustments of hydraulic valves or the like.

The resistance force is adjusted at the cranks 20. As shown, the rods 22 are connected to the cranks 20 by knobs 29 at opposite sides of the device. By loosening the knobs 29 the point at which the rods 22 are connected to the cranks 20 can be moved in or out along the length thereof. When in the outermost position there is maximum resistance, and when innermost there's the least resistance to arm 19 movement imposed by the hydraulic shocks 22,23. The cranks 20 have a series of lock grooves 30 along the length thereof so that both shocks 22,23 can be indexed to the same setting. By sliding the pin 29' along the slot 30' and securing it in the proper groove 30 by tightening the knob, it is possible to have both set at high or low, or one at high and the other at low, since the arm 19 operates the two cranks 20 in unison. Since the combination of the resistance provided by the cylinders is additive, this makes it possible to select the resistance force from within a fairly wide range.

The station at the cushion 11 end of the machine is not confined to knee or leg exercises. It can also be adjusted to do chest exercises. In these exercises the user is lying on the unit face up and is pulling the arm 19 from back above his head to over towards his hips (known as shoulder extension or the pull-over exercise) or from above his hips to up and over his body to back above his head (known as shoulder flexion or the chest press exercise.) In both exercises the sweep of the arm is about 180 degrees as contrasted to the 90 degree movement in the knee extension and leg curl exercises.

In order to do the chest pull-over and chest press exercises the parts 25, 27 are first removed to be out of the way. For the chest pull-over exercise the locking means 21 is disengaged to move the starting point of the arm 19 to the horizontal position, as was done with the leg curl exercise. Thereafter the user lies on the table face up with his head at the cushion 11 end of the device. A collar 31 is shown as being attached to the underside of the channel bar 15, at the central lengthwise axis of the machine, see FIG. 3. This is for the purpose of mounting a head rest 31' at the collar 31 for supporting the user's head while he is doing either the chest pull-over or chest press exercises. In the chest pull-over exercise the user aligns his shoulders with the pivot axis of arm 19 and reaches up above his head, grips the horizontally disposed resistance arm 19, and moves it in an arc of 180 degrees from up above his head to down over his hips. By viewing FIG. 1 it will be noted that if the arm 19 starts from the horizontal the shocks 22, 23 will impose a significant resistance force thereon for about the first half of 180 degrees clockwise movement of the arm 19. However, it it is desired to have a significant resistance force imposed on the arm 19 for the full 180 degree sweep thereof this can be provided for in the instant machine by making an appropriate adjustment therein. This is accomplished by disengaging one lock 21 and manually rotating the appropriate crank 20 90° counterclockwise. In this staggered configuration one piston cylinder crank combination 22, 23, 20 provides significant resistance for the first 90° of motion and the second combination provides significant resistance for the final 90° of excursion. Now when the resistance arm 19 is moved 180 degrees clockwise first the unadjusted crank arm 20 and its corresponding hydrualic shock will come into play to impose a resistance force on the arm 19 for about the first ½ or 90 degrees of movement thereof. Thereafter the crank arm 20 which was adjusted to be on the other side of the legs 14 from that shown in FIG. 1, and its corresponding hydraulic shock, will come into play for the second ½ or 90 degrees of movement of the resistance arm 19. In other words, although in FIG. 1 the cranks 20 and their shocks are shown as having the same orientation, these parts can be adjusted or moved relative to each other, so that in effect they become operative with respect to the resistance arm 19 in a staggered or sequential manner. This results in significant resistance for 180° of excursion. Previous hydraulic exercisers without this feature could offer significant resistance for only approximately 90° of excursion. A still further refinement is possible in that the load can be adjusted to be either light or heavy at either the start or finish of the entire sweep of the resistance arm 19, in this case, 180 degrees for chest pull-over exercises. This is accomplished by loosening the knobs 29 and adjusting the point at which the piston rods are connected to the staggered or offset adjusted crank arms 20.

It should be noted that with the three so far described exercises of knee extension, leg curl, and chest pull-over, the invention makes it possible for the resistance arm 19 to have an overall cumulative sweep or distance of travel from start to finish of about 270 degrees. This is from the full down position shown in FIG. 3, through the horizontal up or out position shown in dotted outline in FIG. 2, and then 180 degrees up from the FIG. 2 position to the other horizontal finish position above the table 10–12. And, within this total cumulative 270 degree sweep or distance of travel for the resistance arm 19 it is possible to put the arm 19 at any start position, and to vary the resistance forces imposed thereon, and also for only a short duration, or throughout the full sweep thereof.

In the chest press exercise the user assumes the same position on the table 10–12 that he had with the chest pull-over exercise, except in this case the start position for the resistance arm 19 is from above the user's hips and the finish is above the user's head. In other words, movement is opposite to that just described with the chest pull-over exercise. Of course, to set up the machine to do the chest press exercise both locks 21 will first have to be disengaged and the arm 19 swung over to be above the central part of the table 10–12. The user then gets on the table beneath the arm 19 so that it is above his hips and then the user raises the arm 19 from that position up over his body to back over and above his head. Of course, the cranks 20 will have been positioned in a staggered way similar to that described with the chest pull-over exercise so that one hydraulic shock imposes a resistance force during the first ½ travel of the arm 19 and the other hydraulic shock during the final ½ of arm 19 travel, or however desired, depending upon the needs or desires of the exerciser user. In both the chest pull-over and press exercises the user returns the arm 19 to start position manually. Such return movement is not resisted by the one-way acting piston-cylinders 22, 23.

All four of the just described exercises are performed at one end or station known as the flexion or extension station of the exercise unit or table 10–12, that is at the cushion 11 end of the device. As will be more clear hereinafter, the cushion 12 corresponds to a second exercise station, at which multiple exercises, of a still different nature can be performed. At the cushion 11 station of the unit single or one way acting hydraulic shock absorbers 22, 23 are employed. These can comprise standard store bought shelf items. The shocks 22, 23 are conventional, with valves in the pistons so that they impose a resistance force on the rods 22 only in extension.

Besides the hydraulic shocks being standard shelf items, it should be noted that the remainder of the device also uses readily available stock parts. That is to say, the exercise unit essentially uses commonly available or readily fabricated materials such as channel bars, cushions, hollow tubing which can be easily bent to shape, and the like. This contributes to keeping the cost of the unit very low, and reducing its number of parts to a bare minimum. Yet, the unit is very versatile in terms of its number of uses and adjustability. These same advantages are applicable to both stations of the exercise unit. The other end station will be described shortly after first a detailed description of the locking means 21.

Figure 5:
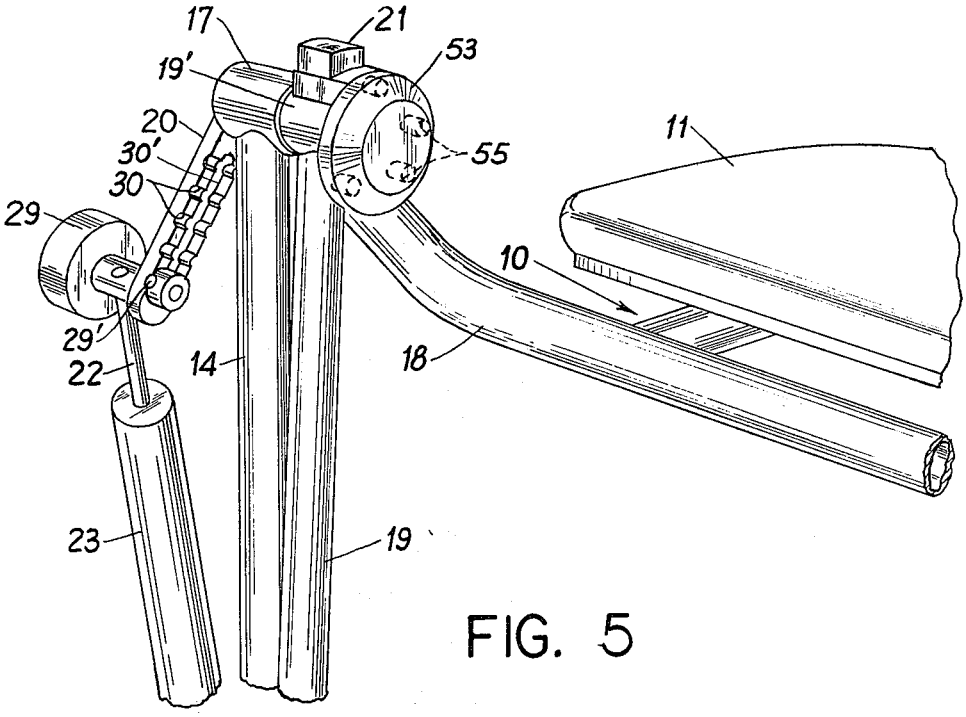
FIG. 5 is an enlarged view of the adjusting means on the far side at the left hand end of FIGS. 1–3.

As shown in FIGS. 5 and 6, the locking means 21 comprises a spring loaded button 51 fastened to a tapered shot pin 52. This may be considered as one piece and is housed and retained within a cavity 21' formed within locking means 21 fastened to arm 19 at its collar 19'. Disc 53 is firmly affixed to crank shaft 54 which in turn is firmly affixed to crank 20. No relative motion is possible between these elements. Disc 53 has four equally spaced holes 55 arranged 90° circumferentially apart from each other. When the shot pin 52 engages a hole 55 in disc 53, the assembly 20,54,53 is locked to the assembly 19, 21. Pushing against the arm 19 transmits force through the system 21,52,53,54,20 to the cylinder piston rod 22. Disengaging the shot pin 52 from the hole 55 in the disc 53 permits relative motion between the crank 20 and arm 19. The left hand crank assembly is the same as the right hand one and they can be positioned independent of each other.

Now that one end station of the device has been described, the other end station will now be described. The other end station, corresponding to the cushion 12 end of the exercise unit is best shown in FIGS. 2–4. FIG. 4 is a perspective view comparable to that of FIG. 1 but of the other end of the device. In FIG. 4 the parts of the unit corresponding to the cushion 11 end or station of the device have been omitted for purposes of clarity of the other station.

Still referring to FIGS. 1–4, the closed end of the U-shaped base frame member 10 is spanned by a channel bar 32. A pair of pivot hubs 33 are provided on the channel bar 32 for a pair of exercise resistance arms 34, 35 which extend out from beneath the table 10–12 to beyond the edge of the table. At their outer ends the resistance arms have collars 36' which are adapted to receive handles or leg cradles depending upon what kind of exercises will be performed.

The resistance arms 34, 35 are pivoted on the pivots 33 intermediate their opposite ends on axes perpendicular to the exercise table. The inner end of arm 34 has a rigid link 36 connected thereto, and the inner end of arm 35 has a rigid link 37 connected thereto. The link 36 is aligned lengthwise with arm 34, whereas the link 37 is at a right angle with respect to the arm 35 in the direction of arm 34, see FIG. 2. The two rigid links 36 and 37 are interconnected by a synchronizing and balancing link 38 which is pivotally connected at its opposite outer ends to the outer ends of the rigid links 36,37. What the link 38 does is synchronize movement of the two arms 34, 35 in both (or opposite) directions of movement thereof, and it also ensures that equal resistance forces are also imposed on the arms 34, 35 also in both and opposite directions of movement thereof. The linkage 36–38 is positioned beneath the table 10–12 below the channel bar 32 in a safe out of the way place.

Both arms 34, 35 also have a rigid adjusting arm 39 connected thereto. The arms 39 are similarly orientated. That is to say, they extend laterally of the arms 34, 35 away from the table 10–12 at angles of about 60 degrees with respect to the arms 34, 35. Hydraulic shock absorbers comprising cylinders and piston rods 40, 41 are connected to the frame 10 and adjusting arms 39. The outer ends of rods 41 are pivotally connected to the arms 39 by slide collars 42 on the arms 39. The collars 42 can be moved along the arms 39 and locked in position along the length thereof at indents 43 along the length thereof by locking means 44 on the collars 42. The outer ends of rods 41 are connected to adjustable slide collars 42 at pivot points 45, and the remote ends of the cylinders 40 are connected to the frame 10 at pivot points 46.

As at the other exercise station, at the instant exercise station the hydraulic shocks are standard shelf items comprising single (or one-way) shock absorbers with valved internal pistons. However, in the instant cushion 12 station end of the device the two shocks are not both resistive in extension, but only one is so, whereas the other is resistive in compression. The arms 34, 35 are moved away and towards each other when doing exercises. In one direction of movement one hydraulic shock absorber imposes the resistive force, and in the other direction the other shock provides the resistive force. However, even though only a single shock acts during each phase of opposite movement of the arms 34, 35 equal or balanced forces are imposed on each arm 34, 35 and they move equally or in unison because of the equalizing linkage 36–38. This is advantageous since solely a pair of shocks will do the whole job, and there are no unnecessary complications such as the need for hydraulic reversing controls, valves or the like.

Referring to FIG. 2, in the arrangement shown, the upper or left hydraulic shock is resistive in compression, but not in extension, and the opposite is true of the bottom or right hydraulic shock. In other words, when the arms 34, 35 are separated or spread this movement is resisted by the upper or left shock, and when being brought together the resistive force is then supplied by the bottom or right shock.

At this station the exercises which can be performed are seated leg adduction (leg scissor), seated hip abduction (hip extension), and prone shoulder raise and prone pull-down exercises. The latter two can be performed in either the face up or face down body position.

In the seated leg scissor exercise the user sits on the cushion 12 with his back or backbone generally perpendicular to the horizontal plane of the table 10–12 or at an obtuse angle relative thereto with the legs hung over the end of the table. The legs are received in leg receiving cradles 47 fitted in each of the collars 36' and indicated in dotted outline in FIG. 3. The cradles 47 can be U-shaped, but I prefer L-shaped ones with straps 48 since I find this more comfortable. The legs rest in the cradles 47 at the back of the leg just above the knee joint. The body position is the same for the hip extension exercise. In the leg scissor exercise the legs are moved from a spread open position to a closed position, and in hip extension they are moved from the closed position to a spread open position. These two exercises can be performed together at one time. That is to say first a leg scissor, then a hip extension, then another leg scissor, then another hip extension, and so on alternately one immediately after the other with each countermovement being opposed by a resistive force. The legs spread apart position of the mechanism is indicated in FIG. 2 in dotted outline. Also, it should be noted that in FIG. 2 the left slide collar 42 on the arm 39 is in the farthest out position, whereas the right slide collar 42 is in the furthest in position. This means that in this setting of the parts the left hydraulic shock 40, 41 is providing most of the resistive force whereas the right hydraulic shock is providing very little or almost no resistive force. In FIG. 4 the opposite is true since the positions of the slide collars 42 on the arms 39 has been switched or reversed. Of course, if both collars are in their furthermost out positions then both cylinders are acting to impose maximum resistive force in both directions of movement of the arms 34, 35; that is to say towards and away from each other. What this means is that just the leg scissor exercise (legs being brought together) can be performed under load with no counterforce to spreading the legs, or just the hip extension exercise (legs being spread apart) can be performed under load with no counterforce to closing the legs, or both exercises can be done in alternate fashion with resistive force to both spreading and closing of the legs.

In the prone, face up, shoulder raise and back pull-down exercises the leg cradles 47 are removed from the collars 36' and handles or hand grips 49 such as indicated in dotted outline in FIG. 4 are substituted therefor. When the user lies on the table 10–12 in face up position he should try to position his shoulder blades above the two pivot points 33. In the shoulder raise exercise he will grip the handles 49 and move the parts from the dotted line position shown in FIG. 2 to the solid line position. For back pull-down exercise he will do the opposite. These two exercises can also be done in body face down position. What was said heretofore with respect to the leg scissor and hip extension exercises is also applicable here. That is to say, shoulder raise can be performed alone under load with no resistance to countermovement (arms being lowered), back pull-down can be performed along under load with no resistance to countermovement (arms being raised), or both exercises can be performed together in alternate sequential fashion with resistive force to movement in both directions. As before, this will be at the option of the user, depending upon whether one collar 42 is in the in position and the other in the out position as illustrated in FIGS. 2 and 4, or whether both collars are set in the out position. Naturally, setting both collars in their full position permits exercise in both direction with very light resistive force.

Referring to FIG. 2 particularly, it should be noted that when the left arm 34 is rotated counterclockwise the link 36 causes the link 38 to push the link 37 clockwise so that the right arm 35 moves in the opening direction simultaneously with the left arm 34. When the left arm 34 is moved clockwise then the linkage 36, 38, 37 causes the right arm 35 to move in closing direction along with left arm 34. Movement of just the right arm 35 has a comparable effect on the left arm 34 by virtue of the same interconnecting linkage 37, 38, 36. Thus, the system is balanced. Both exercise arms 34, 35 have to move in unison, and any load (or no load) which is imposed by either cylinder 40 on either one of the arms 34, 35 is simultaneously imposed on the other of the arms 34, 35. This again is because of the interconnecting linkage 36–38. The entire system is a closed kinematic chain comprising parts 40, 41, 42, 39, 34, 36, 38, 37, 35, 39, 42, 41, 40. If either of the hydraulic shock absorbers 40, 41 or input arms 34, 35 acts or is acted upon this causes the whole system to react.

The first exercise station described (cushion 11 end of table) is for knee extension, leg curl, chest pull-over, and chest press exercises. These all are flexion/extension exercises for the arm and leg limbs. The second exercise station (cushion 12 end of table) is for leg scissor, hip extension, shoulder raise, and back pull-down exercises. These all are abduction/adduction exercises for the arm and leg limbs. Thus the first station is a flexion/extension exercise station, and the second an abduction/adduction exercise station. So, the device provides a bench, opposite ends of which are for a different class of exercises, and within each class there is a multiplicity of exercises performed in the seated, prone face up and face down positions, and for both the arms and legs, and hips and shoulders, and with the inclusion of minor accessory items, back, stomach and elbow exercise patterns could be suitably accomplished.

Although there has been shown and described one embodiment of the invention and various uses thereof it will be obvious to those skilled in the art that the invention is not necessarily restricted thereto. Other exercises, for example, can be performed with the device. For instance, it is possible for a user to sit in front of the second station with arms outstretched, facing the handles 49 and work them in and out with his arms. Also, although the bench has been shown as being rectangular in shape, it does not have to be so. It could have other shapes, and the unit could also be made collapsible to facilitate transport or crated shipment of the same. For example the legs 13, 14 could be made collapsible or removable. If removable they can be placed on the cushions 11, 12. Disengaging the pivot connections 24 will allow swinging the cylinders 23 up to the plane of the table, and operating the locks 21 will allow swinging of the cranks 20 and exercise arm 19 on to the table. This will compact the device for shipment in a relatively flat rectangular carton.

In the invention each exercise station is independent of the other. Matched pairs of cylinders are provided at each station and they are inter-related with each other and the input exercise arms so that simple linear shock absorbers simulate the performance of more complicated rotary resistance elements. At one station (cushion end 11) it is possible to do knee and shoulder flexion and extension exercises, and at the other hip and shoulder abduction and adduction exercises. Thus, each station is adapted for both upper and lowerbody exercises.

While there has been shown and described a preferred form of the invention it will be obvious to those skilled in the art that the invention is not restricted thereto and the full spirit and scope thereof is to be adjudged by the appended claims.

I claim:

1. An exercise device, comprising a table, an exercise station at opposite ends of said table, said table being adapted to have a user of said exercise device seated at either end thereof or prone thereon in either lengthwise direction of said table, input exercise arms having hydraulic cylinder means for exerting a resistance to only one direction of motion connected to each input arm for resisting the motion of that arm in one direction at each of said stations, and said arms and cylinders being adapted at one of said stations for knee extension, leg curl, chest pull-over and chest press exercises, and at the other station for leg scissor, hip extension, shoulder raise and back pull-down exercises.

2. In an exercise device as in claim 1, said input exercise arms and hydraulic cylinder means at said other station comprising a pair of exercise lever arms pivoted at their inner ends on spaced axes which are perpendicular to said table, a link affixed to the inner ends of said lever arms, an interconnecting link pivotally connected at its opposite ends to the free end of said lever arm links, and a hydraulic shock absorber connected to each of said lever arms.

3. In an exercise device as in claim 2, adjusting means for varying the resistive force imposed on said lever arms by said shock absorbers, said adjusting means comprising an adjusting arm connected to each of said lever arms, a lockable slide collar on said adjusting arms, and said shock absorbers being connected to said lever arms at said slide collars.

4. An exercise device, comprising a table, an exercise station at opposite ends of said table, said table being adapted to have a user of said exercise device seated at either end thereof or prone thereon in either lengthwise direction of said table, input exercise arms having resistive hydraulic cylinders connected thereto at each of said stations, said arms and cylinders being adapted at one of said stations for lower and upper body flexion and extension exercises and at the other station for lower and upper body abduction and adduction exercises, said input exercise arms and resistive hydraulic cylinders at said one station comprising a generally U-shaped member which is pivotally mounted at its free ends on a common axis which is transverse and parallel to said table, a pair of cranks at said free ends pivotal on said axis, the resistive hydraulic cylinders being connected to each of said cranks.

5. In an exercise device as in claim 4, adjusting and locking means for changing the disposition of said cranks with respect to each other and said U-shaped member and of said U-shaped member with respect to said cranks.

6. In an exercise device as in claim 5, further adjusting and locking means for adjusting the point at which said shock absorbers are connected to said cranks.

7. An exercise device comprising an elongated table having cushion means thereon and supported in elevated position on a plurality of legs, said table being adapted to have an exercise user seated at either end of said table or prone thereon in either lengthwise direction thereof, an exercise station at each end of said table, said exercise stations each comprising an input exercise arm and a hydraulic piston-cylinder for exerting a resistance to only one direction of piston motion adjustably connected to the input arm for resisting the motion of that arm in one direction and means removably connected to said arms at one of said stations for performing knee extension, leg curl, chest pull-over and chest press exercises and at the other station leg scissor, hip extension, shoulder raise and back pull down exercises.

8. An exerciser including a relatively flat and rectangular table having cushion means thereon and adapted to have an exercise user seated at opposite ends thereof and prone thereon in opposite lengthwise directions thereof when performing exercises, one end of said table constituting one exercise station thereon comprising; an exercise arm and a crank both being pivotally mounted adjacent each other on a common axis, releasable locking means for causing said crank and arm to pivot in unison about said common axis, and a hydraulic piston-cylinder having one of its ends pivotally connected to the outer end of said crank to impose a force on said crank which is resistive to movement of said arm; the other end of said table constituting a second exercise station thereon comprising; a pair of exercise arms which are pivotally mounted for opposite movement towards and away from each other in a common plane, a pair of opposite acting resistive hydraulic piston-cylinders having one of their ends pivotally connected to different ones of said arms, and an equalizing linkage interconnecting said arms to synchronize opposite movement of said arms with respect to each other and balance the resistive force imposed on said arms by said piston-cylinders when moved towards and away from each other.

9. An exerciser as in claim 8, wherein the exercise arm, crank, locking means and hydraulic piston-cylinder at said one station is mounted at said one table end outboard thereof and is adapted for performing knee extension, leg curl, chest pull-over and chest press exercises, and wherein the pairs of exercise arms and hydraulic piston-cylinders and equalizing linkage at said second station is mounted at said other table end beneath the table and is adapted for performing leg scissor, hip extension, shoulder raise and back pull-down exercises, whereby said second station exercise table is adapted to perform lower and upper body flexion and extension exercises at said one station and lower and upper body abduction and adduction exercises at said second station.

10. A lower and upper body flexion and extension exercise device, comprising a table supported on a pair of spaced legs, a U-shaped input exercise arm, the free ends of said input arm being pivotally mounted to the upper ends of said legs on a common axis, a pair of cranks pivotally mounted at each of said free ends on said common axis, means for adjustably locking said cranks to move in unison from a similar or staggered position with said input arm, and a pair of one-way hydraulic shock absorbers which are resistive in tension pivotally connected at their opposite ends to said cranks and the lower ends of said legs.

11. In an exercise device as in claim 10, said locking means being disengagable to free said arm and cranks with respect to each other to adjust the position of said cranks with respect to each other and said arm, and adjusting means for varying the point at which said shock absorbers are connected to said cranks.

12. A hydraulic exercise device comprising a table having a generally U-shaped and elongated horizontal base frame with cushion means thereon, a short U-shaped member affixed at its closed side to the open end of said base frame, a pair of spaced support legs for said table, collars on the upper ends of said legs, said collars being disposed on a common axis transverse to one end of said table and parallel to the plane of said table, the free ends of said short U-shaped member being affixed to said collars, a U-shaped input exercise arm pivotally mounted at its free ends at said collars on said common axis, a pair of cranks pivotally mounted at said collars on said common axis, releasable locking means adjacent said collars for engaging and disengaging said input exercise arm and cranks to either move in unison or move freely of each other, and a one-way hydraulic shock absorber which is resistive only in tension pivotally connected at its opposite ends to each crank and the corresponding lower end of each of said legs.

13. In an exercise device as in claim 12, adjusting means for varying the points at which said shock absorbers are connected to said cranks to vary the resistive force imposed by said shock absorbers on said input exercise arm, and operation of said locking means to disengaged position freeing said input exercise arm for movement to a start down position parallel to said legs of raised position above said table about 270 degrees from the down position, and operation of said locking means to disengaged position also freeing said cranks and shock absorbers to a functional start position on either side of said legs with said cranks approximately 45° with respect to the horizontal.

14. A hydraulic exercise device comprising a table, a pair of pivoted input exercise arms having one of their ends extending out from beneath one end of said table, said arms being pivoted adjacent their other ends to said table on axes which are spaced from each other and perpendicular to said table for pivotal movement with respect to each other in a plane parallel to said table, rigid links at the pivoted ends of said arms, one of said links extending lengthwise of its arm and the other link extending generally perpendicular to its arm in a direction towards the other arm, an equalizing link pivotally connected at its opposite ends to the free ends of the links on said arms for causing said arms to move in unison in opposite directions, adjustable connections on said arms, and a pair of shock absorbers pivotally connected at their opposite ends to the underside of said table and to said adjustable connections.

15. In an exercise device as in claim 14, adjustment of said adjustable connections with respect to said arms being operative to vary the resistive force imposed by said shock absorbers on said input exercise arms, said shock absorbers being oneway acting, one in compression and the other in tension, and said three links being operative to balance the resistive force imposed by said shock absorbers on said exercise arms in either towards or away movement with respect to each other.

16. A hydraulic exerciser comprising a pair of spaced fixed collars which are aligned with each other on a common axis, a generally U-shaped input exercise arm, the free ends of said input exercise arm being disposed between said collars and being pivotally mounted thereto on said common axis, a pair of cranks pivotally mounted on said common axis at the outside of said collars opposite to the free ends of said input exercise arm, means adjacent each of said collars for releasably locking said input exercise arm and cranks together to move in unison from the same or a staggered position, and a pair of hydraulic piston-cylinders pivotally connected at one of their ends to said cranks.

17. In a hydraulic exerciser as in claim 16 wherein release of said locking means is operative to free said input exercise arm and cranks for adjustive positioning with respect to each other, and said hydraulic piston-cylinders having adjustable connections with said cranks whereby the distance of said adjustable connections from said common axis can be adjusted to vary the resistive force imposed on said input exercise arm by said hydraulic piston-cylinders.

18. A hydraulic exerciser, comprising an exercise arm and a crank both being pivotally mounted adjacent each other on a common axis, releasable locking means for causing said crank and arm to pivot in unison about said common axis, and a hydraulic piston-cylinder having one of its ends pivotally connected to the outer end of said crank to impose a force on said crank which is resistive to movement of said arm.

19. In a hydraulic exerciser as in claim 18, wherein release of said locking means is operative to free said arm and crank for adjustive positioning relative each other, and the pivotal connection of said hydraulic piston-cylinder to said crank being adjustive along said crank towards and away from said common axis to adjust the resistive force imposed on said crank by said piston-cylinder.

20. A hydraulic exerciser comprising an exercise arm and a pair of cranks, said arm and cranks being pivotally mounted adjacent each other at one of their ends on a common axis, releasable locking means for causing said cranks and arm to pivot in unison about said common axis, and a pair of hydraulic piston-cylinders having one of their ends pivotally connected to the outer ends of said cranks to impose a force on said cranks which is resistive to movement of said arm, said locking means being releasable to selectively adjust the relative position of said cranks with respect to each other and said arm so that the cranks can act resistively in unison on said arm from the same starting position or be staggered with respect to each other so that their resistive forces are superimposed additively on said arm thereby permitting significant sequential resistance on said arm throughout a range of 180° pivotal movement thereof.

21. In a hydraulic exerciser as in claim 20, said releasable locking means being mounted adjacent said axis and comprising a pair of individual manually operable crank-to-arm lock mechanisms for each of said cranks, and further adjusting means on each of said cranks for selectively adjusting the point at which each of said piston-cylinders is pivotally connected to its respective crank whereby the resistive force imposed by each of said cranks on said exercise arm can be selectively adjusted to be of equal or different magnitude.

22. A hydraulic exerciser comprising a pair of exercise arms which are pivotally mounted for opposite movement towards and away from each other in a common plane, a pair of opposite acting resistive hydraulic piston-cylinders having one of their ends pivotally connected to different ones of said arms, and an equalizing linkage interconnecting said arms to synchronize opposite movement of said arms with respect to each other and balance the resistive force imposed on said arms by said piston-cylinders when moved towards and away from each other.

23. In a hydraulic exerciser as in claim 22, said opposite acting piston-cylinders having adjustable connections with said arms to vary the resistive force imposed on said arms by said piston-cylinders to opening said closing movement of said arms with respect to each other.

24. In a hydraulic exerciser as in claim 23, said adjustable connections comprise adjusting arms offset approximately 60° on said exercise arms, lockable slide collars on said adjusting arms for adjustive movement therealong, and said piston-cylinders being pivotally connected to said exercise arms at said slide collars.

25. In a hydraulic exerciser as in claim 22, said arms being pivotally mounted at one of their ends on a pair of spaced axes, the other ends of said arms being free for movement towards and away from each other, said equalizing linkage comprising a chain of three links, one of said links having one of its ends affixed to the pivoted end of one of said arms and extending lengthwise of said one arm, a second of said links being affixed to the pivoted end of the other of said arms and extending in a direction perpendicular thereto towards the one link, and a third of said links being pivotally connected at its opposite ends to the free ends of said one and second links.

* * * * *